United States Patent [19]

Kloppenburg

[11] Patent Number: 4,842,427

[45] **Date of Patent: * Jun. 27, 1989**

[54] PLOTTING MECHANISM MOUNTED ON A RIBBON CASSETTE FOR TYPEWRITERS OR OFFICE MACHINES

[75] Inventor: Ernst Kloppenburg, Grossefehn-4-Strackholt, Fed. Rep. of Germany

[73] Assignee: AEG Olympia Aktiengesellschaft, Wilhelmshaven, Fed. Rep. of Germany

[ * ] Notice: The portion of the term of this patent subsequent to Mar. 28, 2006 has been disclaimed.

[21] Appl. No.: 111,508

[22] Filed: Oct. 22, 1987

[30] Foreign Application Priority Data

Oct. 22, 1986 [DE] Fed. Rep. of Germany ..... 3635861

[51] Int. Cl.[4] ..... B41J 29/28

[52] U.S. Cl. ..... 400/18; 400/21; 400/207

[58] Field of Search ..... 400/16, 17, 18, 19, 400/20, 21, 22, 82, 144.2, 196, 196.1, 207, 208, 208.1; 346/46, 49, 50, 51, 52, 139 R, 141

[56] References Cited

U.S. PATENT DOCUMENTS

| | | | |
|---|---|---|---|
| 4,259,025 | 3/1981 | Jamieson | 400/208 |
| 4,425,045 | 1/1984 | Crystal | 400/144.2 |
| 4,533,924 | 8/1985 | Takahishi | 346/49 |
| 4,578,685 | 3/1986 | Tanaka et al. | 346/49 |

FOREIGN PATENT DOCUMENTS

| | | | |
|---|---|---|---|
| A891271 | 9/1953 | Fed. Rep. of Germany . | |
| 89185 | 5/1984 | Japan | 400/17 |
| 93375 | 5/1984 | Japan | 400/17 |
| 52370 | 3/1985 | Japan | 400/82 |
| 52370 | 3/1985 | Japan | 400/82 |
| 172763 | 8/1986 | Japan | 400/616.1 |

*Primary Examiner*—David A. Wiecking
*Attorney, Agent, or Firm*—Spencer & Frank

[57] ABSTRACT

A plotting device for typewriters or office machines of similar construction which comprises a motor driven carriage; a record carrier; a print head; a ribbon in a cassette; a reversible, controllable drive motor for moving the record carrier up and down; the motor driven carriage being movable along the record carrier; the ribbon being housed within the carriage with a portion of the ribbon extending outside of the carriage for being contacted by the print head; the print head being operatively connected to the carriage so that the print head can strike the ribbon and produce a full set of alphanumeric characters on the record carrier; an X-Y plotting mechanism equpped with styli and being disposed on the cassette; and a control system for moving the styli from a detent position into an operating position with respect to the record carrier.

10 Claims, 2 Drawing Sheets

PLOTTING MECHANISM MOUNTED ON A RIBBON CASSETTE FOR TYPEWRITERS OR OFFICE MACHINES

BACKGROUND OF THE INVENTION

1. Field of the Invention

The present invention relates to a plotting mechanism for typewriters or office machines.

2. Discussion of the Prior Art

Several line-drawing devices for drawing horizontal and vertical lines on typewriters are known. However, they are rarely encountered in practice which may indicate that they have not been found satisfactory or are too great an impediment for the typing process.

German Patent No. 891,271 discloses a holding device for typewriters to accommodate a threaded ball-point writing implement cartridge in which a threaded holder for the writing cartridge is disposed on the card holder to the right or left of the type face guiding head and is fixed thereto by means of a clamp. The plastic card holder has a threaded sleeve on the writing cartridge instead of an insertion hole. Such an arrangement interferes with the typing process, particularly in machines in which the print head is disposed on a carriage which moves along the record carrier. Exchange of the ball-point pen cartridges would also require a certain amount of skill on the part of the machine operator.

U.S. Pat. No. 4,527,176 discloses a multi-color printer in which different color styli are disposed at the periphery of a drum-like holder. However, setting of this printer to one of the desired colors is very complicated. Further, DE-OS No. 3,619,567 which corresponds to U.S. patent application Ser. No. 07/060,468, now U.S. Pat. No. 4,813,796 to Kittel discloses a ribbon cassette equipped with a color stylus in a displacement element which, by way of a handle attached thereto, can be pushed from an out-of-engagement position into a ready position. Although this device permits the creation of simple drawn lines in the horizontal, vertical or also in any other direction, the displacement of this displacement element must still be made by hand.

SUMMARY OF THE INVENTION

It is an object of the present invention to provide a plotting mechanism for typewriters or similar office machines which is able to produce, in addition to a full set of printed characters, any desired single or double drawn lines in the horizontal, vertical or any other direction. The selection of the stylus is to be effected by means of a keyboard signal or, in on-line operation, by means of software without requiring any special manual actuation.

The plotting mechanism permits the creation of full sets of printed characters in the conventional manner, for example by means of a daisy wheel printing mechanism as well as any desired drawn lines in the x and y direction by means of an additional stylus disposed in a displaceable member. A further feature makes it possible for the displaceable member to be equipped with styli which can be simply and quickly moved into the starting position and into one of the desired operating positions without the need for additional mechanical means.

This further feature of the invention permits the easy removal from and replacement into the machine of the plotting mechanism.

It is a further object of the invention to produce a mechanism that will allow the styli to be used with conventional machines not originally designed for use with the styli.

The styli can be set simply and easily and requires no additional driving devices in the machine.

The above and other objects are accomplished by the invention in which a plotting device for typewriters or office machines of similar construction comprises a motor driven carriage, a record carrier, a print head, a ribbon and a reversible controllable drive motor means for moving the record carrier up and down. The motor driven carriage is movable along the record carrier, and the ribbon is housed within the carriage with a portion thereof extending outside of the carriage for contact with the print head. The print head is operatively connected to the carriage so that it can strike the ribbon and produce a full set of alpha-numeric characters on the record carrier. An X-Y plotting mechanism equipped with styli and disposed on the carriage is provided, as is a control device for selectively moving one of the styli from a detent position into an operating position with respect to the record carrier.

BRIEF DESCRIPTION OF THE DRAWING

The invention may be better understood by referring to the detailed description of the invention when taken in conjunction with the accompanying drawing in which.

DESCRIPTION OF THE PREFERRED EMBODIMENT

Figure 1:
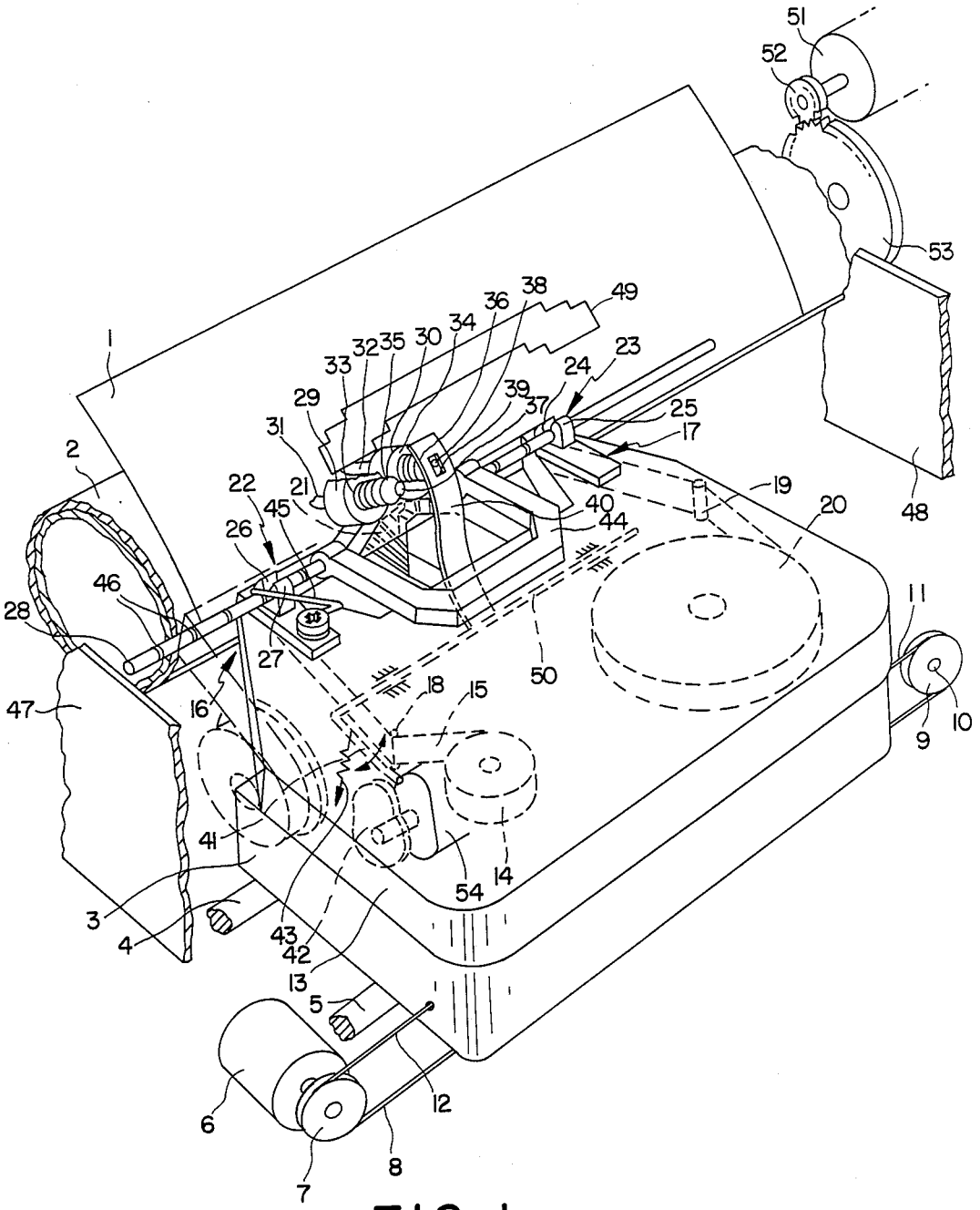
FIG. 1 shows a schematic view of an office machine utilizing a ribbon cassette with a plotting mechanism.

FIG. 1 shows a carriage 3 which is movable along a record carrier 1 via shafts 4, 5 and which is driven by means of a stepping motor 6. By means of a cable drum 7, this stepping motor 6 drives a cable pulley 8 whose ends 11, 12 are fixed to carriage 3. Moreover, at the side opposite motor 6 in the machine housing, cable 8 is reversed by way of a guide roller 9 which is rotatably mounted on a shaft 10.

Record carrier 1 is transported over a platen 2. A gear 53 is fixed to this platen 2 and is in driving connection with the drive pinion 52 of a stepping motor 51. A ribbon cassette 13 in which a supply reel 14 and a take-up reel 20 are rotatably mounted is exchangeably disposed on carriage 3. Ribbon 15 is unwound from supply reel 14 by means of a transporting device whereby the ribbon 15 is brought out of an exit opening 16 to the printing station and is then returned via an entrance opening 17 to take-up reel 20. Ribbon 15 is additionally guided within the cassette by deflection pins 18 and 19.

The plotting mechanism disposed on carriage 3 includes a print head 21 for generating a full set of alphanumeric characters on record carrier 1 through the intermediary of ribbon 15. The print head is composed, for example, of a conventional daisy wheel equipped with type faces disposed on resilient spokes. This daisy wheel is set in a known manner by means of a stepping motor, with the set character then being moved by a printing hammer against record carrier 1.

An X-Y plotting mechanism equipped with styli is also disposed on carriage 3, with its styli 31, 32 being brought by means of a control device from a detent position into an operating position for printing on record carrier 1. This plotting mechanism comprises a displaceable member 44 equipped with a plurality of juxtaposed styli 31, 32, with member 44 being disposed on a bearing shaft 28 fixed to carriage 3 so as to be displaceable thereon in the direction of movement of carriage 3 and arrestable. Shaft 28 is provided with a number of detent notches 46 corresponding to the number of juxtaposed styli 31, 32 into which a resilient detent element 45 can engage which is stationarily disposed on carriage 3. This ensures a secure and simple arrest for the respectively selected stylus 31, 32 in the operating position.

Displaceable member 44 includes bearings 29, 30 equipped with bearing bores 33, 34 in which the color styli are disposed so as to be displaceable against the force of springs 35, 36 with respect to record carrier 1. At their ends facing away from record carrier 1, styli 31, 32 can be charged by a control member and thereby displaced from the detent position into the operating position. This control member is, for example, a resilient pivot lever 40 which is permanently connected with a shaft 50 which is pivotal by means of a cam 42. The resilient pivot lever 40 is composed of a leaf spring provided at its free end with a recess 39 for coupling it to pin-shaped extensions 37, 38 at the ends of styli 31, 32.

As shown in the drawing figure, the plotting mechanism is movable together with carriage 3 and is connected to ribbon cassette 13. For this purpose, the upper face of cassette 13 is provided with two bearing blocks 22, 23 having bores in which shaft 28 of displaceable member 44 is mounted so as to be rotatable and displaceable. These bearing blocks 22, 23 are provided with slit-like openings for receiving shaft 28. The slit-like openings are bounded by arms 24, 25, 26 and 27. Displaceable member 44 is also arranged so as to be displaceable on cassette 13 in the direction of movement of the carriage.

The spring wire 45, which serves as the resilient detent element, is also fastened to cassette housing 13. Rotary shaft 50 and leaf spring 40 are likewise disposed on the exchangeable cassette 13, rotary shaft 50 being mounted so as to engage and rotate at the underside of cassette 13. Rotary shaft 50 is additionally provided with a bent, projecting arm 41 which can be coupled to the receptacle for carriage 3 by means of a cam 42 when cassette 13 is seated on the receptacle. A spring 43 articulated to the bent, projecting arm 41 always keeps shaft 50 forcefully engaged with cam 42. When cassette 13 is removed from carriage 3, the plotting mechanism together with displaceable member 44 and rotary shaft 50 are also removed from the machine. It is then possible to insert into the machine either a normal ribbon cassette not equipped with the above-described plotting mechanism or a ribbon cassette having such a plotting mechanism.

Setting of the plotting mechanism is accomplished by arranging the carriage 3 together with print head 21 and the plotting mechanism so that they are moveable beyond one of the margin positions. By moving them beyond one of the margin positions the plotting mechanism is brought into its basic position where the styli does not contact the record carrier 1. Then carriage 3 is moved into the other margin position and to a different extent far beyond this margin position to place the desired stylus 31, 32 into the operating position whereby the stylus contacts the record carrier 1. For this purpose, shaft 28 is provided with extensions which can be brought into engagement with the left side wall 47 and right side wall 48 of the machine housing so as to displace displaceable member 44 into its basic position or into one of its operating positions. The respectively set position of shaft 28 is ensured by engagement of wire spring 45 in one of detent notches 46. This ensures easy adjustment of displaceable member 44 with respect to styli 31, 32.

With displaceable member 44 set as shown in the drawing figure, the stylus 32 is in the operating position. The stylus is brought into contact with record carrier 1 by means of leaf spring 40 of rotary shaft 50. Displacement of stylus 32 from the detent position into the operating position is effected by means of cam 42 which pivots rotary shaft 50 and leaf spring 40 counterclockwise against the force of spring 43. The cam 42 may be provided on the movable carriage 3 for another function or may be specifically installed for the purpose of this invention. By means of the appropriate control instructions to stepping motors 6 and 51, the carriage 3 and the plotting mechanism are moved over platen 2 in such a manner that, for example, an outline 49 is produced on record carrier 1. With corresponding controls to the two motors 6 and 51 from a control element, e.g. a microprocessor, geometric figures can be generated on record carrier 1. A full set of alpha-numeric characters may be produced in a known manner by a print head 21 configured in the form of a daisy wheel. The plotting mechanism is a supplemental invention for wellknown typewriters producing a full set of printed characters. If the typewriter is in printing position then the styli do not contact the record carrier 1. Thereby, the styli 31, 32 are out of position of the rotary shaft 50 and the leaf spring 40. For this purpose, the plotting system has always to be brought into its basic position by moving the carriage 3 in the left direction engaging the shaft 28 with the left side wall. Setting of the plotting mechanism is accomplished by engaging the shaft 28 with the right side wall 48 of the machine housing.

Figure 2:
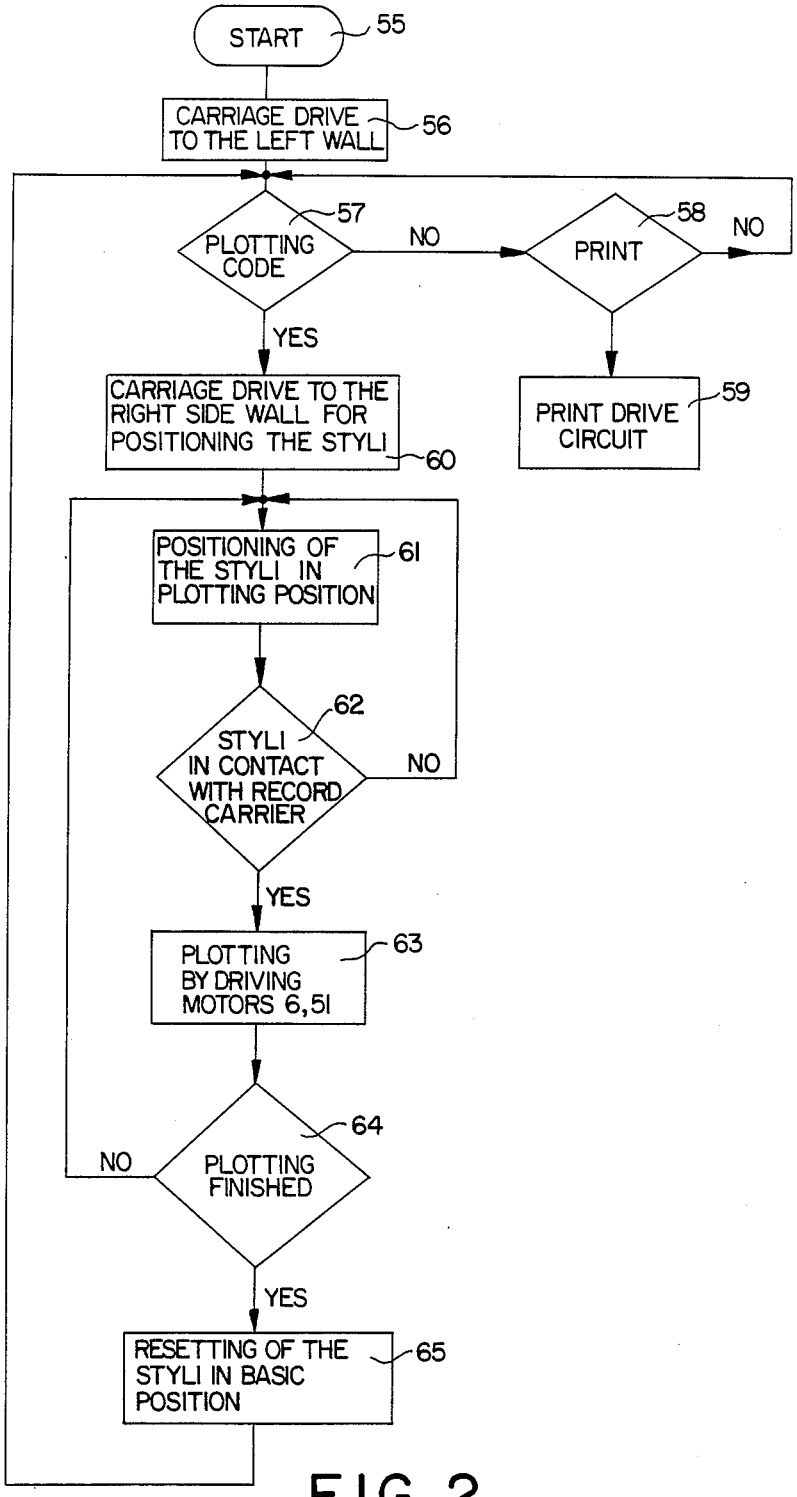
FIG. 2 shows a flowchart of how the microprocessor functions to draw lines.

FIG. 2 illustrates a flow diagram of the program executed by the processor conformable to U.S. Pat. No. 4,030,591. The invention is operable in typewriters or other similar machines for producing a full set of printed characters and plotted lines conformable to flow diagram which will now be explained.

Block 55—The typewriter is switched on.

Block 56—The microprocessor caused to bring the carriage 3 to the left side wall.

Block 57—The microprocessor transfers a control signal to controller 57 if plotting is desired.

Block 58—If there is not a plotting signal, then the controller 58 sends a signal to the print drive circuit 59.

Block 59—The print drive circuit 59 is caused to bring the printer to print position for printing alphanumeric characters.

Block 60—The microprocessor is caused to bring the carriage to the right side wall 48 for positioning the styli 31 or 32.

Block 61—The carriage 3 with the positioned styli will be brought in plotting position on the record carrier.

Block 62—the controller proofs if the styli 31 or 32 is in contact with the record carrier.

Block 63—the microprocessor sends signals to the driving motors 6 and 51.

Block 64—The controller proofs if the plotting act is finished.

Block 65—The microprocessor transfers signals to motor 54 for resetting the cam 42 and the styli 31, 32 in basic position.

It will be understood that the above description of the present invention is susceptible to various modifications, changes and adaptations, and the same are intended to be comprehended within the meaning and range of equivalents of the appended claims.

What is claimed is:

1. A plotting device for typewriters or office machines of similar construction comprising:

a motor driven carriage;

a record carrier;

a print head;

a ribbon;

a ribbon cassette having a supply reel, a take-up reel and guide means disposed in said ribbon cassette, said ribbon being unwound from said supply reel and guide by said guide means to said take-up reel;

a reversible, controllable drive motor means for moving said record carrier up and down, said motor driven carriage being movable along said record carrier, said ribbon being housed within said ribbon cassette and said ribbon cassette being removably disposed on said carriage with a portion of said ribbon extending outside of said ribbon cassette for being contacted by said print head, and said print head being operatively connected to said carriage so that said print head can strike said ribbon and produce a full set of alpha-numeric characters on said record carrier;

an X-Y plotting mechanism mounted on said ribbon cassette and equipped with styli; and control means for selectively moving one of said styli from a detent position into an operating position with respect to said record carrier.

2. A plotting device according to claim 1, wherein said plotting mechanism further comprises a displaceable member and a bearing shaft; said displaceable member being disposed on said bearing shaft and said styli being disposed in a juxtaposed relationship on said plotting mechanism.

3. A plotting device according to claim 1, wherein each of said styli has a longitudinal axis and said plotting mechanism further comprises a displaceable member; and a shaft disposed in a direction transverse to the longitudinal axis of said styli, said displaceable member being connected to said shaft, said shaft being disposed on said carriage and said styli being disposed in a juxtaposed relationship on said plotting mechanism.

4. A plotting device according to claim 3, wherein said shaft is provided with a number of detent notches corresponding to the number of juxtaposed styli, and said plotting mechanism includes a resilient detent element which is stationarily disposed on said carriage and engageable in said detent notches.

5. A plotting device according to claim 3, wherein said styli may be placed in a detent position and an operating position, said operating position being defined by one of said styli contacting said record carrier and said detent position defined by said styli not contacting said record carrier and wherein said plotting mechanism further comprises bearings having bearing bores, a spring and a control member, said styli being disposed in said bearing bores, a first end of said styli being selectively connected to said control member so that said control member may displace said styli from said detent position into said operating position, and said spring being located so that said styli are displaceable with respect to said record carrier against the force thereof.

6. A plotting device according to claim 5, further comprising a rotatable shaft, said control member being a resilient pivot lever connected with said rotatable shaft.

7. A plotting device according to claim 6, wherein said first end of said styli includes a pin-shaped projection and said resilient pivot lever is a leaf spring which includes at one end a recess for coupling to said pin-shaped projection.

8. A plotting device according to claim 7, further comprising a ribbon cassette which includes a cassette housing having an underside, wherein said rotatable shaft and said leaf spring are mounted on said underside of said cassette so as to engage therein; said pivotable shaft including a bent, projecting arm operatively connected to a cam.

9. A plotting device according to claim 1, wherein each of said styli has a longitudinal axis and said cassette includes a cassette housing having an upper side, said upper side being provided with a spring wire and two bearing blocks each of which has a bearing bore; said plotting mechanism further comprises a rotatable member which includes a shaft, said shaft of said rotatable member being rotatably and displaceably mounted in said bearing bores of said bearing blocks so that said shaft is disposed transverse to the longitudinal axis of said styli; said spring wire being fastened to said cassette housing and serving as a resilient detent element.

10. A method of setting a plotting mechanism of a plotting device for typewriters or office machines of similar construction which includes a motor driven carriage; a record carrier; a print head; a ribbon; a ribbon cassette having a supply reel, a take-up reel and guide means disposed in said ribbon cassette, said ribbon being unwound from said supply reel and guided by said guide means to said take-up reel; a reversible, controllable drive motor means for moving said record carrier up and down, said motor driven carriage being movable along said record carrier, said ribbon being housed within said ribbon cassette and said ribbon cassette being removably disposed on said carriage with a portion of said ribbon extending outside of said ribbon cassette for being contacted by said print head, and said print head being operatively connected to said carriage so that said print head can strike said ribbon and produce a full set of alpha-numeric characters on said record carrier; control means for selectively moving one of said styli from a detent position into an operating position with respect to said record carrier; and said X-Y plotting mechanism being mounted on said ribbon cassette and equipped with styli, said plotting mechanism further including a position where one of the styli contacts the record carrier being called the printing position and the position where the styli do not contact the record carrier being called the basic position, the method comprising the steps of:

arranging the carriage, the plotting mechanism and the print head so as to be movable beyond first and second margin positions;

moving the carriage beyond said first margin position so part of said control means abuts one component of the machine whereby the plotting mechanism is brought into a basic position; and moving the carriage beyond said second margin position so that another part of said control means abuts another component of the machine whereby one of the styli is adapted to be placed into the printing position by said control means.

* * * * *